US008926796B2

(12) United States Patent
Jogikalmath et al.

(10) Patent No.: US 8,926,796 B2
(45) Date of Patent: Jan. 6, 2015

(54) BULK AND STIFFNESS ENHANCEMENT IN PAPERMAKING

(71) Applicant: Nanopaper, LLC, Cambridge, MA (US)

(72) Inventors: Gangadhar Jogikalmath, Cambridge, MA (US); David S. Soane, Chestnut Hill, MA (US); Andrea Schneider, Hyde Park, MA (US)

(73) Assignee: Nanopaper, LLC, Cambridge, MA (US)

( * ) Notice: Subject to any disclaimer, the term of this patent is extended or adjusted under 35 U.S.C. 154(b) by 0 days.

(21) Appl. No.: 13/672,015

(22) Filed: Nov. 8, 2012

(65) Prior Publication Data

US 2013/0160958 A1 Jun. 27, 2013

Related U.S. Application Data

(60) Provisional application No. 61/557,519, filed on Nov. 9, 2011, provisional application No. 61/584,489, filed on Jan. 9, 2012.

(51) Int. Cl.
*D21H 11/00* (2006.01)

(52) U.S. Cl.
USPC ..... 162/161; 162/164.1; 162/162; 162/158

(58) Field of Classification Search
USPC ..... 162/161, 164.1, 162, 155, 158, 184; 427/424, 391; 106/287.26
See application file for complete search history.

(56) References Cited

U.S. PATENT DOCUMENTS

| | | | | |
|---|---|---|---|---|
| 3,607,486 | A | 9/1971 | Jacks et al. | |
| 3,865,918 | A | 2/1975 | Mitchell et al. | |
| 4,144,122 | A * | 3/1979 | Emanuelsson et al. | 162/158 |
| 4,208,301 | A | 6/1980 | Gammon | |
| 4,432,833 | A | 2/1984 | Breese | |
| 5,137,768 | A | 8/1992 | Lin | |
| 5,674,832 | A | 10/1997 | Keys | |
| 5,753,079 | A | 5/1998 | Jenny et al. | |
| 5,792,856 | A | 8/1998 | Allen et al. | |
| 5,853,542 | A | 12/1998 | Bottorff | |
| 5,858,173 | A | 1/1999 | Propst, Jr. | |
| 5,873,979 | A | 2/1999 | Naieni | |
| 5,876,510 | A | 3/1999 | Kuemin et al. | |
| 5,994,530 | A | 11/1999 | Posey-Dowty et al. | |
| 6,051,108 | A | 4/2000 | O'Neal, Jr. | |
| 6,171,444 | B1 | 1/2001 | Nigam | |
| 6,201,060 | B1 | 3/2001 | Jansen et al. | |
| 6,416,624 | B1 | 7/2002 | Nielsen et al. | |
| 6,686,054 | B2 | 2/2004 | Nigam | |
| 6,969,443 | B1 | 11/2005 | Kokko | |
| 7,591,926 | B2 | 9/2009 | Becker et al. | |
| 7,854,822 | B2 | 12/2010 | Chmielewski et al. | |
| 8,067,524 | B2 | 11/2011 | Kokko | |
| 2004/0035538 | A1 | 2/2004 | Kokko | |
| 2004/0182532 | A1 | 9/2004 | Becker et al. | |
| 2006/0118258 | A1 | 6/2006 | Chmielewski et al. | |
| 2008/0294132 | A1 * | 11/2008 | Tan et al. | 604/360 |
| 2009/0165976 | A1 | 7/2009 | Soane et al. | |
| 2010/0042062 | A1 | 2/2010 | Fernkvist et al. | |
| 2012/0006499 | A1 | 1/2012 | Jogikalmath et al. | |
| 2013/0068407 | A1 | 3/2013 | Jogikalmath et al. | |
| 2013/0112361 | A1 | 5/2013 | Mikami et al. | |

FOREIGN PATENT DOCUMENTS

| | | | |
|---|---|---|---|
| EP | 1013825 | A1 | 6/2000 |
| WO | 2006060221 | A2 | 6/2006 |
| WO | 2008069711 | A1 | 6/2008 |
| WO | 2010080958 | A1 | 7/2010 |

OTHER PUBLICATIONS

U.S. Appl. No. 13/761,254, filed Feb. 7, 2013.

* cited by examiner

*Primary Examiner* — Mark Halpern
(74) *Attorney, Agent, or Firm* — Elmore Patent Law Group, P.C.; Mahreen Chaudhry Hoda; Carolyn S. Elmore, Esq.

(57) ABSTRACT

The present invention provides formulations for papermaking and methods for their use. In embodiments, the formulations include a treatment agent and a fluid carrier, where the treatment agent includes a volatile debonder or a polymer composition exhibiting a lower critical solution temperature. Methods for treating a paper product to increase its bulk or its stiffness are also disclosed, in addition to paper products formed from such methods.

9 Claims, 10 Drawing Sheets

BULK AND STIFFNESS ENHANCEMENT IN PAPERMAKING

RELATED APPLICATIONS

This application claims the benefit of U.S. Provisional Application Ser. No. 61/557,519, filed Nov. 9, 2011 and U.S. Provisional Application Ser. No. 61/584,489, filed Jan. 9, 2012. The entire contents of the above applications are incorporated by reference herein.

FIELD OF THE APPLICATION

This application relates generally to debonders for enhancing bulk and stiffness in paper products.

BACKGROUND

The customer judges the quality of paper products by evaluating a combination of properties, including smoothness, gloss, brightness and feel. In particular, tactile feedback indicating a higher caliper (thickness) for the paper conveys the impression that the product is of high quality. Making paper thicker, though, typically involves using more pulp, so that the paper is heavier and more expensive. To produce a thicker paper without incorporating additional pulp, the papermaking industry has identified a number of inexpensive particulate additives that act as low-density fillers to create the feel of a thicker paper while decreasing weight and cost. Examples include EXPANCEL® (Akzo Nobel) and OMNIBULK® (Kemira).

Such fillers, however, can impair the strength and resiliency of the final product, and do not hold up well under the forces applied during calendaring. Therefore, a need exists in the industry for formulations and methods to enhance the bulk of paper products while yielding sheets that remain strong and flexible. Desirably, such formulations and methods are compatible with existing papermaking techniques and equipment.

In addition to bulk, paper industry also desires an improvement in stiffness of paper products. There is particularly need for such improvement in packaging industry where rigidity is necessary for structural reasons and fine papers where rigidity is necessary to ensure that the paper can undergo repeated bending in copying and printing processes yet retain its dimensional stability.

SUMMARY

Disclosed herein, in embodiments, are formulations for use in a sizing step for a paper product, comprising: a treatment agent, wherein the treatment agent comprises a volatile debonder or a polymer composition exhibiting a lower critical solution temperature; and a fluid carrier with which the treatment agent forms an emulsion or a solution. In embodiments, the volatile debonder is evaporable from the paper product during the sizing step. In embodiments, the polymer composition has a higher affinity for cellulose fibers in the paper product when a temperature of the paper product is above a transition temperature than when the temperature is below the transition temperature. In embodiments, the treatment agent is formulated in an aqueous solution or emulsion for dispersal by spraying on the paper product. In embodiments, the treatment agent is dispersible within a sizing solution used during the sizing step. In embodiments, the bulking agent comprises a polyetheramine. Examples of such polyetheramines that can be used include, for example, the JEFFAMINE® class of polymers. In embodiments, the treatment agent is a bulking agent. In other embodiments, the treatment agent is a stiffening agent.

Also disclosed herein, in embodiments, are methods for treating a paper product to increase its bulk, comprising preparing a bulking formulation as an aqueous solution or emulsion, wherein the bulking formulation comprises a volatile debonder or a polymer composition exhibiting a lower critical solution temperature; applying the bulking formulation to the paper product during a sizing step of papermaking; and drying the paper product, thereby treating the paper product to increase its bulk. In embodiments, the bulking formulation is applied to the paper product by spraying. In embodiments, the bulking formulation is blended with a sizing solution, and the sizing solution is applied to the paper product during the sizing step. In embodiments, the methods further comprise evaporating the volatile debonder from the paper product. In embodiments, the methods further comprise raising the temperature of the paper product above a transition temperature, wherein the polymer composition has a higher affinity for cellulose fibers above the transition temperature than it does below the transition temperature, and wherein raising the temperature of the paper product above the transition temperature increases the bulk of the paper product.

Further disclosed herein, in embodiments, are methods for treating a paper product to increase its stiffness, comprising preparing a stiffening formulation as an aqueous solution or emulsion, wherein the stiffening formulation comprises a volatile debonder or a polymer composition exhibiting a lower critical solution temperature; applying the stiffening formulation to the paper product during a sizing step of papermaking; applying a starch-containing formulation to the paper product; and drying the paper product. In embodiments, the stiffening formulation is applied to the paper product by spraying. In embodiments, the stiffening formulation is blended with a sizing solution, and the sizing solution is applied to the paper product during the sizing step. In embodiments, the methods further comprise evaporating the volatile debonder from the paper product. In embodiments, the methods further comprise raising the temperature of the paper product above a transition temperature, wherein the polymer composition has a higher affinity for cellulose fibers above the transition temperature than it does below the transition temperature, and wherein raising the temperature of the paper product above the transition temperature increases the stiffness of the paper product.

In other embodiments, methods are disclosed herein for incorporating an advantageous compound into a paper product, comprising: preparing a bulking or stiffening formulation as an aqueous solution or emulsion, wherein the bulking or stiffening formulation comprises a volatile debonder or a polymer composition exhibiting a lower critical solution temperature; preparing an additive formulation comprising the advantageous compound as an aqueous solution or emulsion; applying the bulking or stiffening formulation to the paper product during a sizing step of papermaking; applying the additive formulation to the paper product; and drying the paper product, wherein the advantageous compound is incorporated into the paper product following the step of drying the paper product. In embodiments, the advantageous compound comprises starch. In embodiments, the advantageous compound is selected from the group consisting of an oil/grease resistance agent, an optical brightener, an ink binder, a dust preventer, a water repellent, a stiffener, a biocide, a biomolecule for controlled release, a superabsorbent polymer, a gloss strength builder, a colorant, an adhesion-release agent, a diagnostic sensor agent, a filtration assist agent, a targeted capture/sequestrants agent and a biomedical component.

In addition, paper products are disclosed herein that are formed by the aforesaid methods.

DETAILED DESCRIPTION

A. Debonders as Bulking Agents

Disclosed herein are formulations and methods for adding bulk to sheet paper by using debonders. It has been unexpectedly discovered that various debonding agents can be used advantageously as treatment agents to enhance the bulk of sheet paper products, both uncoated free sheets and coated free sheets (e.g., light weight coated, super calendared). Not to be bound by theory, it is understood that a debonding agent can reduce hydrogen bonds between cellulose fibers, acting as a spacer molecule to separate the cellulose fibers during their processing. Thus, the debonding agent can prevent capillary action from consolidating the cellulose fibers during the drying process, so that these fibers do not consolidate as densely, resulting in a sheet having increased caliper.

Figure 1:
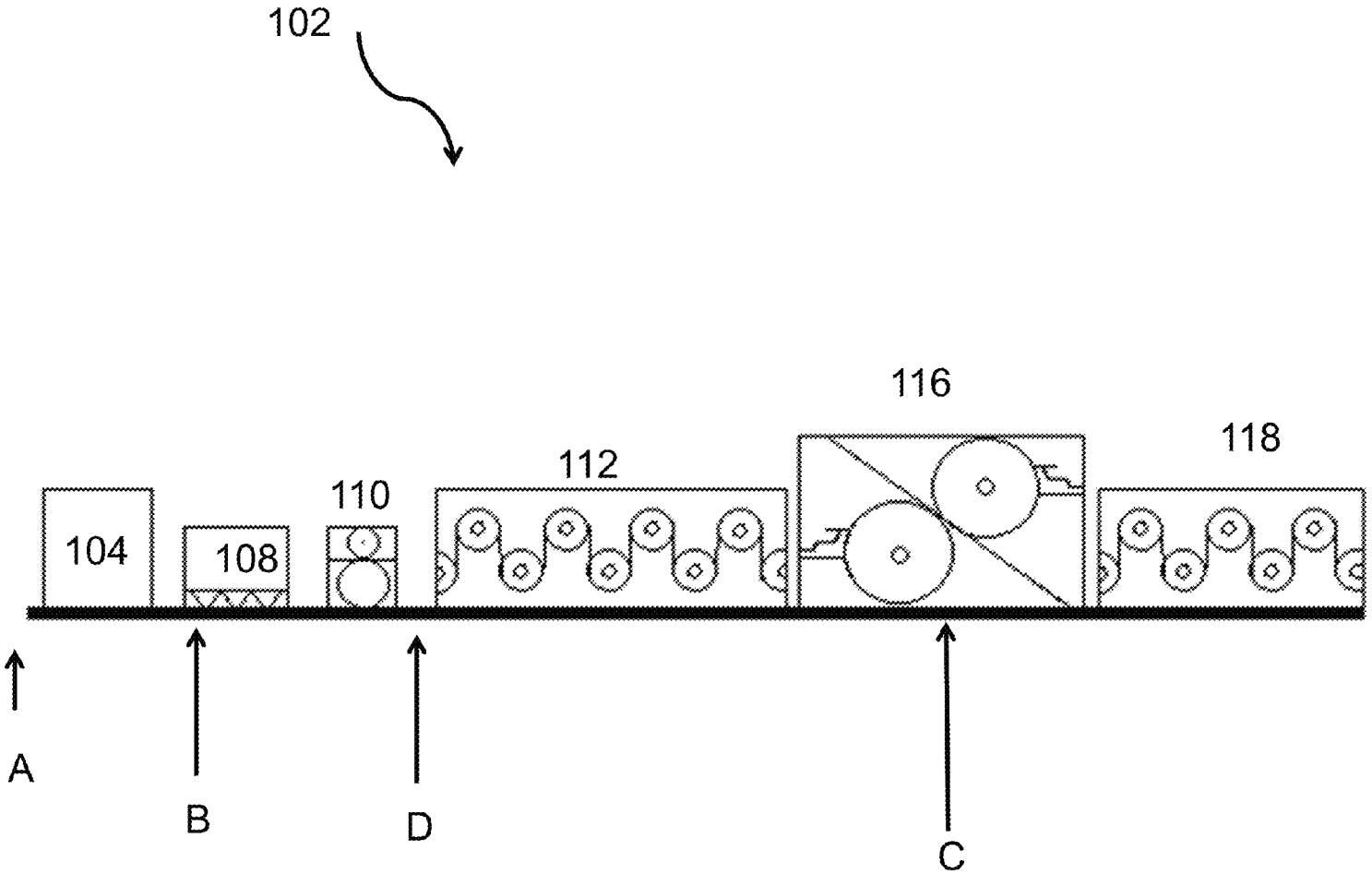
FIG. 1 shows a schematic diagram of a papermaking process.

As shown in FIG. 1, a papermaking assembly 102 can comprise a number of elements that process the pulp to form the final sheet product. As shown in the Figure, a headbox 104 is provided to introduce the pulp slurry (not shown) into the papermaking assembly 102. At Point A, debonders as described herein can be introduced into the papermaking process before it passes into the headbox. A vacuum section 108 removes some of the liquid from the pulp slurry. At Point B, debonders as described herein can be introduced into the papermaking process, before the vacuum section 108 to improve penetration of the debonders. A press section 110 removes more liquid from the pulp slurry as it is formed into a paper web. At point D, after the press section 110, debonders as described herein can be introduced into the papermaking process. A drying section 112 removes more of the moisture from the paper web. The paper web can then pass into a size press 116 for imparting starch or other binder based sizing to the paper (either on one side or both sides of the paper). Debonders as described herein can be introduced into the size press solution, or can be metered onto the size press 116 to be incorporated into the paper. The paper then passes into a dryer 118 for final drying.

1. Volatile Debonders as Bulking Agents

In embodiments, volatile debonders can be introduced into the papermaking process at discrete points, such as Points A, B, D or C as depicted in FIG. 1. A volatile debonder is an agent that is capable of interacting with cellulose pulp to decrease the intermolecular forces in the paper web, but is also capable of evaporating under processing temperatures so that there is minimal residual debonder when the paper web is pressed into final form.

As would be understood by skilled artisans, during the early stages of drying the cellulose fibers are not bonded to each other. Adding a volatile debonder, as disclosed herein, to the paper web prior to drying (e.g., at Point A, Point B or Point D in FIG. 1) can serve to keep the cellulose fibers apart. As drying progresses, the cellulose fibers in the paper web are normally drawn together. The presence of a volatile debonder interferes with this bond formation and holds the fibers apart. As drying progresses, though, the volatile debonder evaporates, but the cellulose fibers remain spaced apart from each other. This condition, where the paper fibers are spaced apart from each other as the paper dries, results in a product with greater bulk.

In other embodiments, volatile debonders can be added to the paper sheet after the drying process, for example at Point C in FIG. 1. Such debonders can be added, during the size press process, for example, by being incorporated into the size press solution, or by being applied separately to the paper web before it enters the size press, or during the size press process. Volatile debonders added during the size press process can act upon the paper sheet to space apart the fibers, thereby increasing the bulk of the paper sheet. When the sheet is dried again following size pressing, the volatile debonders are driven off so that the paper sheet is virtually free of residual debonder.

In embodiments, volatile debonders useful as bulking agents can be derived from a class of organic molecules that can be volatilized using the high temperatures available in the paper making process. These organic molecules capable of acting as volatile debonders can be added to the wet-end or the size press. The volatile debonders do not affect the wet-strength of the wet-web, resulting in lower breaks and allowing the paper machine to run at higher speeds than is possible with traditional debonder systems. The debonding occurs as the minority component of volatile debonder in the white water concentrates while the web moves along the drying section, so that consolidation of the cellulose fiber mat is prevented. The volatile debonder then can be removed in the final stages of drying such that the dry sheet is debonded, has a higher caliper and does not contain residua of the debonding agent.

As an example, a volatile debonder can be added, in embodiments, to the wet end of the papermaking process: for example, on the wet web after the head box, to the wet web before the press section, or after the press section but before the dryers. In embodiments, the volatile debonder can be added as shown in FIG. 1, at Point A, Point B or Point C. In embodiments, the volatile debonder can also be added, for example by spraying or topically applying the volatile debonder formulation at relevant points during the papermaking process, for example at Points A, B or C.

In embodiments, the volatile debonder can be added to the size press application system. The volatile debonder can then separate the cellulose fibers and increase the caliper, while volatilizing in the secondary dryer section. In embodiments, the volatile debonder can be mixed into a water-based sizing solution, which can comprise agents such as water, cooked starch, hydrophobic chemicals, colors, brightening agents, and the like.

A formulation comprising a bulking agent can be termed a bulking formulation. In embodiments, formulations are prepared where the bulking agent is a water-soluble debonder, but where the water and the active debonder ingredient can form an azeotropic mixture that allows both water and debonder to be evaporated together at a working temperature for the papermaking process. An azeotrope is a mixture of two or more liquids, the composition of which does not change upon distillation. Such liquid mixtures behave like a single substance in that the vapor produced by partial evaporation of liquid has the same composition as the liquid. Thus, the mixtures distill at a constant temperature without change in composition and cannot be separated by normal distillation.

In embodiments, active debonder ingredients can be selected that have specific hydrophilic or hydrophobic properties, but that are still water-soluble and capable of forming azeotropic mixtures with water that can be evaporated at a working temperature for the papermaking process. In embodiments, a positive azeotropic mixture can be formed, for example one having a constant boiling point lower than the boiling point of water. In other embodiments, a negative azeotropic mixture can be formed. Advantageously, the azeotrope formed by the water and the volatile debonder is designed so that both agents boil off at the processing temperature of the pulp during the drying stage of papermaking, approximately 110-180° C., with the presence of the volatile debonder acting to keep the paper fibers sufficiently separated that they are less likely to form intermolecular bonds. Although certain of these compounds boil at temperatures higher than that of paper processing/drying, the fact that they form azeotropes helps in their removal during the drying temperatures encountered in the papermaking process. Once the sheet is dried at temperatures of >90° C., the molecules evaporate, leaving behind a very small amount, or no residue and a sheet with enhanced bulk.

Not to be bound by theory, it is understood that during the early stages of the drying process in papermaking, the pulp enters the drying section of the mill containing about 60% water. The free water in the pulp acts as a capillary attractant, pulling the cellulose fibers towards each other. As the free water is driven off during drying, the fibers are drawn even closer together as intermolecular bonding takes place. This normal process of papermaking yields a strong paper sheet.

When the volatile debonders disclosed herein are used as bulking agents, the intermolecular processes in the paper product are different, as is the final result. In embodiments, the water-soluble volatile debonders as disclosed herein can act as spacers to separate the cellulose fibers, so that they do not draw close enough to form hydrogen bonds during drying. The spacing between the pulp fibers produced by the debonder decreases the fibers' capacity for intermolecular bonding, just as occurs with traditional organic debonders. The co-presence of the debonder molecules and the water molecules impairs the ability of the cellulose fibers to form bonds; because the debonder and water form an azeotropic mixture, their co-presence is assured throughout the evaporation process, so that the distance between the cellulose fibers is maintained. Furthermore, because the volatile debonders disclosed herein evaporate along with the water during drying, the final product does not contain undesirable organic residua.

2. Lower Critical Solution Temperature Debonders as Bulking Agents

In embodiments, certain polymers having lower critical solution temperature (LCST) properties can be used as bulking agents. Without being bound by theory, it is understood that these polymers exhibit a temperature-dependent solubility phenomenon called Lower Critical Solution Temperature (LCST). Such agents, e.g., certain polymers such as those containing ethylene oxide and propylene oxide monomers, are soluble in water or aqueous solutions at temperatures below the LCST, while heating the solutions leads to polymer precipitation from the solution above the LCST. In embodiments, the LCST property of these polymers can be used as additives during the papermaking process to enhance bulk, relying on the differences in temperature during papermaking to cause and maintain their deposition on the paper fibers. In embodiments, the solubility of these polymers is temperature-dependent, so that the polymer is soluble at lower temperatures, but is insoluble at higher temperatures: thus, when the temperature rises in a mixture containing the LCST polymer in solution with cellulose fibers, the LCST polymer tends to deposit on the fiber surfaces. The presence of the polymer on the fiber surfaces can inhibit fiber-fiber attractions due to hydrogen bonding, so that the fibers assume a spaced-apart configuration. With the increased spacing between the fibers, the fiber density per unit volume decreases, and the bulk of the final product increases.

In embodiments, LCST polymers can be used for bulk enhancement of paper products where the polymer has a higher affinity for cellulose fibers above its transition temperature. In some embodiments, a bulking agent can include a LCST polymer (either a portion of or the entirety of the molecule) or other material exhibiting a lower critical solution temperature (e.g., a copolymer containing ethylene oxide and propylene oxide units) that can allow it to deposit on the cellulose fibers as the temperature is increased, for example during the drying or size press steps of papermaking. With reference to FIG. 1, a LCST polymer can be applied during the wet end of papermaking, at Point A or Point B, or during the size press process, for example at Point C. When applying a LCST polymer as a bulking agent during the size press process, it can, in embodiments, be incorporated into the size press solution, or applied separately to the paper web before it enters the size press or during the size press process.

In embodiments, a treatment agent can be selected for use as a bulking agent at a specified phase of the papermaking process. For the fabrication of fine sheet paper, for example, the papermaking machine operates at a high speed. Accordingly, it may be less desirable to use a bulking/debonding agent during the wet phase of papermaking, where it can impair the strength of the sheet as it moves across the papermaking machinery. For these applications, the bulking/debonding agent can be added during the size press process. Volatile debonding/bulking agents and LCST agents can be used during the size press process. In embodiments, the use of these agents can be combined with other additives and formulations that comprise the size press solution, such as starch, fiber, ash, particulates and the like. In embodiments, the debonding/bulking agents as disclosed herein are suitable for use in the production of uncoated free sheet paper as well as coated free sheet paper.

B. Exemplary Bulking Agents

In embodiments, a class of molecules having a range of HLB values (HLB: hydrophilic lipophilic balance, where a value of 0 means a completely hydrophobic molecule and a value closer to 20 indicates a hydrophilic molecule) that are miscible with water can be used as bulking agents in accordance with this disclosure. In embodiments, these molecules can be used as volatile debonders, because they have varying boiling points that can be selected in accordance with their attraction to the underlying surface so that they change the surface energy (and hence the wetting or non-wetting characteristics of the surface) in a temporary manner. In embodiments, these molecules can be used as bulking agents.

In embodiments, volatile molecules useful as bulking agents are water-miscible. In embodiments, certain of these molecules can form azeotropic mixtures with boiling points that are compatible with the operating temperatures of the papermaking process. In embodiments, the azeotropic mixture formed between the volatile bulking agent and water will evaporate during drying. In embodiments the volatile bulking agent compounds can be sprayed onto a wet paper web during the papermaking process.

One such class of molecules includes glycol ethers having aliphatic and/or aromatic side chains. As examples, a number of glycol ethers having advantageous properties as volatile debonders are included in the DOWANOL® line of solvents (DOW Corp., Midlands Mich.). In other embodiments, glycol ethers having advantageous properties include those manufactured as Acrosolv products from Lyondell-Basell (Houston, Tex. USA) or Eastman solvents from Eastman Chemicals (Kingsport, Tenn. USA).

Other useful molecules include other Ethylene glycol ethers, such as Ethylene glycol monomethyl ether, Ethylene glycol monoethyl ether, Ethylene glycol monopropyl ether, Ethylene glycol monoisopropyl ether, Ethylene glycol monobutyl ether, Ethylene glycol monobenzyl ether, and the like, and other glycol ether acetates such as Ethylene glycol methyl ether acetate, Ethylene glycol monethyl ether acetate, Ethylene glycol monobutyl ether acetate, and the like. Molecules with higher molecular weights have higher boiling points, a factor that can influence selection as a volatile debonder for papermaking. In embodiments, tripropylene glycol n-butyl ether and tripropylene glycol methyl ether (both with higher molecular weights than certain other glycol ethers) have advantageous properties as volatile debonders. In other embodiments, propylene glycol n-Butyl ether and dipropylene glycol n-butyl ether (both hydrophobic on the HLB scale) have advantageous properties as volatile debonders. Other molecules suitable include branched alkyl alcohols such as Masurf NRW-N (Mason Chemical Company, Ill.).

The extent of debonding, and hence the bulking, can be controlled by the amount of debonder added to the wet paper web and the choice of debonder with a hydrophobic HLB value. In embodiments, volatile debonder compounds have boiling points varying from 100° C. to 290° C. These molecules can be added to the wet-end white water system at concentrations ranging from 0.001 to 1% by weight of the white water in the system. Volatile debonders can be advantageously added in the range 0.001% to 0.1% by weight. In embodiments, volatile debonder compounds can be sprayed in water solution onto a wet moving web, or added thereto as an emulsion, as described below in more detail.

Molecules with lower HLB values can also be used that have a lower boiling point than the drying temperatures of the paper process when faster evaporation may be desirable. As an example, propylene glycol methyl ether is useful for this purpose. It is understood that the more hydrophobic glycol ethers typically have a lower solubility in water, so that when such molecules are used as volatile debonders with a high loading by fiber weight, it may be useful to emulsify them to facilitate their dispersion in an aqueous mixture. For example, a suitable cationic surfactant or other emulsifying agent can be used to enable binding of the hydrophobic glycol ether to the anionic cellulose fibers in the wet-end of the papermaking process.

As an example, tripropylene glycol n-butyl ether (DOWANOL® TPnB) has a solubility limit of ~2.5 wt %. If a loading higher than 3% is required, emulsification can be carried out to create a stable suspension of the TPnB in water at this concentration. Suitable emulsifiers for these purposes can include surfactants such as polyetheramines. As an example, a Jeffamine polyetheramine such as Jeffamine XTJ 502 compound could be used for emulsification of Dowanol TPnB if a loading higher than 3% by weight is desired.

In embodiments, emulsified mixtures having low HLB values can be added to the wet end of the papermaking line. For example, if a polyetheramine such as a Jeffamine is used as the emulsifying agent, the primary amine in the Jeffamine molecule can act as an anchor that binds the debonder to the cellulose fiber surface. In other embodiments, a primary amine such as is present in the Jeffamine emulsifier could act as an anchor group thereby binding the debonder to the fiber surface. In other embodiments, the volatile bulking agent molecules can also be sprayed onto moving webs. Because of their volatility, they are able to exert their effects during the drying stages of papermaking, but they then evaporate off and leave no residuum to impair the hydrophilic nature of a final paper product. Similarly, emulsions and azeotropic mixtures and solutions containing volatile debonders can also be added to the sizing solution at the size press.

In other embodiments, polymers having LCST properties can be used as bulking agents, as described above. As utilized within the present application, the term "polymer" refers to a molecule comprising repeat units, wherein the number of repeat units in the molecule is greater than about 10 or about 20. Repeat units can be adjacently connected, as in a homopolymer. The units, however, can be assembled in other manners as well. For example, a plurality of different repeat units can be assembled as a copolymer. If A represents one repeat unit and B represents another repeat unit, copolymers can be represented as blocks of joined units (e.g., A-A-A-A-A-A . . . B-B-B-B-B-B . . . ) or interstitially spaced units (e.g., A-B-A-B-A-B . . . or A-A-B-A-A-B-A-A-B . . . ), or randomly arranged units. In general, polymers include homopolymers, copolymers (e.g., block, inter-repeating, or random), cross-linked polymers, linear, branched, and/or gel networks, as well as polymer solutions and melts. Polymers can also be characterized as having a range of molecular weights from monodisperse to highly polydisperse. A "type of polymer" refers to a polymer formed from a particular set of repeat units, e.g., A units and B units. A designated polymer type can or cannot have all the polymer molecules be of the same molecular weight and/or have the repeat units oriented identically.

Polymer compositions useful as bulking agents can be configured in a number of different dispositions, e.g., having a polymer where at least one section of the polymer exhibits LCST behavior. These include polymers where the segments are known to exhibit LCST behavior to those skilled in the art. As examples, suitable debonders can include polymers having segments such as polyalkylene oxides (e.g., polyethylene oxide (PEO) or polypropylene oxide (PPO) or a mix of such oxides), ethyl(hydroxyethyl)cellulose, poly(N-vinylcaprolactam), poly(methylvinyl ether), poly(N-isopropylacrylamide), and derivatives of such including those understood by ones skilled in the art. In some embodiments, the polymer composition can comprise only uncharged species. In embodiments, for example, the polymer composition can be at least substantially free of polyelectrolytes (e.g., being substantially or totally free of charges associated with the polymer structure). Thus, in some embodiments utilizing uncharged polymers, the transition temperature of a fiber-containing composition and/or the behavior of a debonder agent, can be substantially dictated by the LSCT of the polymer as opposed to the charges of a specie interacting with fibers.

Polymer composition can include a homopolymer, a copolymer, or a blend of polymers. A blend of polymers can include polymers of different types, e.g., a blend of at least one homopolymer and one copolymer, a blend of copolymers, a blend of a type of polymer where the molecules differ in molecular weight and/or branching. In some embodiments, a blend of polymers of a bulking agent can be disposed as an emulsion (e.g., a blend of a polymer rich in polypropylene oxide segments and a polymer rich in polyethylene oxide segments). The emulsion can allow polymers having different solubilities to be blended to form an appropriate debonding agent.

In some cases, the polymers can have a character that is different from that of conventional ammonium salts used as debonders (e.g., being anionic or neutral in nature). Alternatively, or in addition, the presence of an anchoring group (such as a cationic group or a chemical group such as epoxy or anhydride) in a component of the agent can enhance the stability of the attachment of the agent to a cellulose fiber.

In some embodiments, the polymer composition can be formulated to impart a selected transition temperature range for the cellulose composition. For instance, it can be advantageous to select the polymer composition such that the transition temperature is in the range of temperatures relevant to a papermaking process, e.g., selecting the polymer composition such that wet end processing of paper typically takes place at temperatures below the transition temperature and drying takes place at temperatures above the transition temperature. Accordingly, in some embodiments the components of the polymer composition (e.g., the polymers of a blend or the blocks of a copolymer) of a debonder agent are selected such as to impart a transition temperature for the fiber-containing composition in a range from about 5° C. to about 95° C. For example, a polymer composition can be designed to achieve a certain LCST, and thus impart a corresponding transition temperature when the composition acts as a portion of a bulking agent in a fiber-containing composition, by utilizing a first component having a designated LCST and another component to modify the first LCST.

In some particular embodiments, polymers having different alkylene oxide segment types can be utilized to tailor a transition temperature in a range from about 5° C. to about 95° C. For instance, polymers made of propylene oxide monomers exhibit a LCST of about 5-10° C. while those made with ethylene oxide exhibit a LCST of ~90° C. These transition temperatures are concentration and molecular weight dependent, and can also be affected by the presence of other components in a fiber-containing composition. In particular, the ratio of EO and PO blocks in the molecule can determine the LCST of the resulting copolymer. A copolymer formed using these components can have an LCST that falls between these two temperatures, depending on the relative content of EO and PO blocks in the polymer. Likewise, a blend of polypropylene oxide polymers and polyethylene oxide polymers can also be used with the transition temperature dictated at least in part by the sizes of the individual polymers and their relative amounts.

Not to be bound by any particular theory, it is believed that the bulking molecule binds to the pulp because the temperature of the aqueous environment reduces the solubility of either or both the EO or the PO units. In case of block copolymers that contain EO and PO blocks, increasing the temperature of the polymer solution in presence of the pulp can lead to selective precipitation of either the EO or the PO block onto the pulp fibers. The debonder molecule can be chosen such that the transition temperature of the composition would be in the range of temperatures seen on a papermaking line. For example, a composition with a transition temperature of 35° C. can be deposited into the wet slurry in the headbox where it would precipitate onto the fibers due to the fact that the temperature in the headbox is higher (~45° C.) than the transition temperature of the debonder.

In some embodiments, commercially available polymers can display certain advantageous properties of a hydrophilic debonder imparting a transition temperature that allows its precipitation during the drying phase of papermaking, as described above, along with its reversion to a hydrophilic state at room temperature. For example, the PLURONIC® line of polyethylene oxide (PEO)-polypropylene oxide (PPO) block copolymers (BASF) display these properties when used according to the systems and methods disclosed herein, as described in Examples below.

In other embodiments, a molecule can be prepared that self-assembles around cellulose fibers, thereby preventing hydrogen bonding between neighboring fibers and leading to bulking of the final product. As examples, debonder molecules according to these systems and methods can include oligomeric or polymeric segments including ethyleneoxide (EO) or propyleneoxide (PO) segments or a combination of the two with the segments varying in sizes from n=2 to 10000. In embodiments, the temperature-sensitive solubility behavior of the PPO and PEO blocks in the polymer backbone can produce an affinity towards the cellulose fibers when the temperature of the solution is above the transition temperature of either of the EO or PO based blocks, so that the polymer attaches itself to the cellulose fiber.

In other embodiments, the LCST of a polymer composition, and thus the transition temperature, can be changed by the use of chaotropic salts such as those based on potassium, sodium, and calcium. In some embodiments, for example, potassium salts function well as chaotropic agents for EO based polymers, with the EO blocks self-assembling around potassium ions forming a crown-ether like structure. The presence of chaotropic salts can alter the solution behavior of the debonders by precipitating them out of solution at temperatures lower than the actual LCST. Without being bound by theory, it is understood that adding salt to the polymer can change the structure of water around the molecules, leading to an association of the polymer with the salt and subsequent precipitation, effectively lowering the LCST of the polymer. For example, if a PEO-containing polymer has an LCST of 90° C., the presence of a chaotropic salt in the solution (preferably sodium based) can lower the LCST. Other polymer/salt systems can exhibit similar behaviors, for example, systems using NaCl and the like, whereby a polymer/salt arrangement can self-assemble around the cellulosic fibers. The LCST of the polymer in solution can also be changed by adding suitable surfactants, for example sodium dodecylsulfate or sodium laureth sulfate. For example, addition of sodium dodecylsulfate to a solution of Pluronic L31 [PEO-PPO-PEO] increased the LCST by about 5° C.

C. Debonders and Increased Stiffness

It would be understood by those of ordinary skill in the art that an increase in bulk, as effected by treatment agents such as the debonders and/or bulking agents described herein, can result in a concomitant increase in stiffness. As bending stiffness is directly proportional to the cube of the thickness for a simple plate like a paper sheet, a doubling of thickness improves the stiffness by $2^3$ times (or 8 times). However, it has been unexpectedly discovered that debonders and/or bulking agents as described herein can increase the stiffness of a paper sheet beyond the amount predicted by the increase in bulk alone. Thus, treatment agents such as the debonders and/or bulking agents described herein can act as stiffening agents. A formulation comprising a stiffening agent can be termed a stiffening formulation.

Not to be bound by theory, the use of a treatment agent such as a debonder and/or bulking agent as described herein can separate the fibers within the paper sheet, creating voids within the paper that allow the ingress of the starch in the size press mix. The additional starch imparts more stiffness to the paper product, beyond the stiffness attributable to the increase in bulk. Moreover, the debonders and/or bulking agents described herein can act as plasticizers for the starch used in size press applications, thereby contributing to an increase in stiffness. Without being bound by theory, and in addition to any other mechanisms for viscosity reduction, it can be postulated that a treatment agent, e.g., a co-solvent bulking agent as described herein, can cause the starch molecules themselves to contract and thereby reduce system viscosity.

Plasticizers reduce the amount of water needed for a wet mix to achieve fluidic properties for dispersal and the plasticizers (or co-solvents) also cause the starch molecules to contract by reducing contact with water molecules thereby further reducing the viscosity. By decreasing the viscosity of the starch mix, treatment agents such as the debonding or bulking agents disclosed herein allow improved penetration of the starch into the fibrous web, so that there is a greater amount of stiffness-producing starch in the final sheet; such treatment agents therefore act as stiffening agents.

It is understood by skilled artisans that certain optimal viscosity is desirable for starch solutions added in the size press, so that the starch can be distributed advantageously onto the dried paper sheet. Starch in its cooked form absorbs water, though, and binds it tightly, so that the typical starch solution for size press applications has a high viscosity with a very low starch content. Starch pick-up of wet paper is directly proportional to the viscosity of the sizing solution and the solids content of it. A viscous starch solution with low starch content will result in suboptimal levels of starch in the final paper product, with less desirable stiffness properties. While the starch content can be increased using conventional technologies, the viscosity also increases, interfering with the distribution of the starch within the fibrous network.

By contrast, the treatment agents described herein can increase the solids (starch) content of the sizing solution without increasing the viscosity, allowing improved starch pick-up and distribution within the paper product. When such a treatment agent (e.g., a bulking/debonding agent as disclosed herein), is added to a starch solution, it acts as a plasticizer, so that less water is needed to achieve the optimal viscosity. One example of such a plasticizing agent is the glycol-ether class of debonders described previously. This plasticizing effect can impart additional benefits by facilitating the drying process for the starch-sized paper products.

In another embodiment, the sizing solution containing a treatment agent such as a bulking/debonding/co-solvent agent as described herein can also contain a crosslinkable polymer such as pectin or alginate. Pectin can be crosslinked into a gel with the help of bivalent ions such as Ca++. Upon drying, the gel forms a stiff film, enhancing the rigidity of the paper it is applied to. The pectin crosslinking can be facilitated by an external calcium ion source such as a calcium-containing salt, or by deliberate dissolution of PCC that is contained in the paper, having been added in the wet-end. In an embodiment, a size-press solution containing pectin can have a lower pH (less than 5) to facilitate dissolution of PCC, thereby releasing Ca++ ions and enabling crosslinking of pectin to form a rigid paper.

Figure 10:
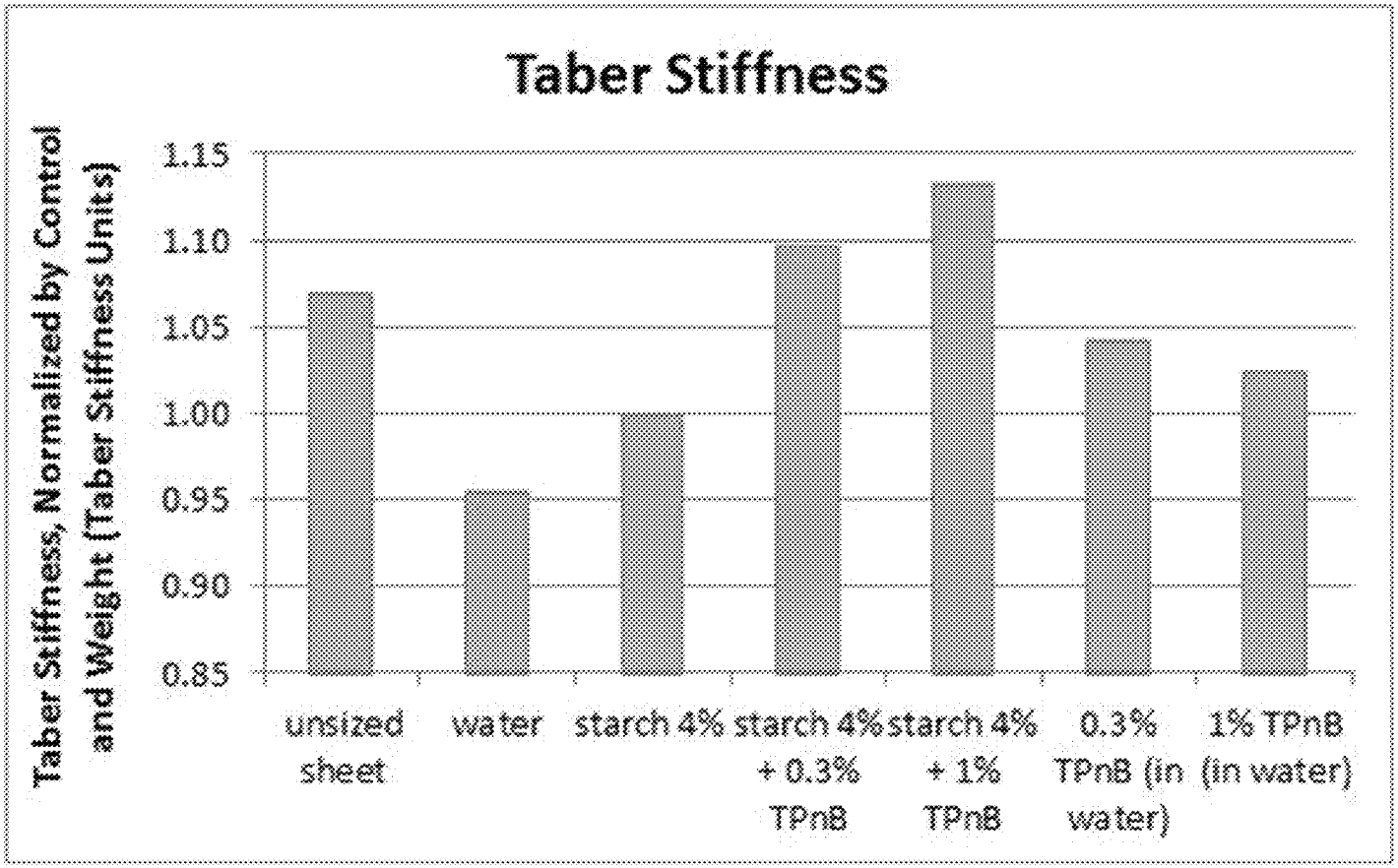
FIG. 10 shows a graph of stiffness of treated paper vs. control.

In embodiments, therefore, the debonder molecules as disclosed herein can act as viscosity reducers for the sizing solution, while also acting as bulking agents that do not remain in the final paper product. The use of minute amounts of these treatment agents as co-solvents (i.e., co-ingredients in the aqueous solution) leads to simultaneous bulking and stiffening, with the stiffening increasing disproportionately to the increase in bulk. This phenomenon is demonstrated by the experiments illustrated in FIG. 10 and described in Example 13 below. As shown in the graph in FIG. 10, the incorporation of a bulking agent alone (here, TPnB at 1% and 0.3%) shows improvement in stiffness compared to the starch sized paper (normalized to starch 4%), due to the accompanying bulking which has a power law relation to stiffness. However, a significant and unexpected improvement in stiffness occurs when the bulking agent is combined with starch. It is hypothesized, without being bound by theory, that the bulking/debonding effect of the TPnB creates pathway and space for the starch to penetrate and occupy within the interstices of the paper thereby strengthening and stiffening the paper upon drying. The impact upon stiffness of this phenomenon is enhanced by the effect of the bulking/debonding agent on the viscosity of the starch solution, whereby a lowered viscosity improves its ability to penetrate the fibrous network.

In embodiments, these same phenomena (debulking and viscosity reduction) can be employed to improve the penetration of other advantageous compounds into a fibrous matrix, for example in papermaking Such advantageous compounds can include oil/grease resistance agents, optical brighteners, ink binders, dust preventers, water repellents, stiffeners, biocides, biomolecules for controlled release, gloss strength builders, colorants, adhesion release agents, and other performance-enhancing agents (e.g., diagnostic sensors, biomedical components, filtration assists, targeted capture/sequestrants agents, and the like). In an embodiment, superabsorbent polymers can be added to a fibrous matrix using these technologies, with the superabsorbent polymer being packaged so as not to imbibe moisture due to the presence of the plasticizer/co-solvent.

EXAMPLES

Materials

In the examples below, the following materials were used (unless otherwise indicated, percentages are weight percentages):

- Softwood pulp
- Processed pulp sheets (670 GSM basis weight)
- Poly propylene oxide polymer (PPO)
- Copolymers of PPO and PEO (Polyethyeleneoxide) in the Pluronics series of polymers from BASF
- Butyl Carbitol (Dow)
- Butyl Cellusolve (Dow)
- DOWANOL® compounds as listed in the following Table 1:

TABLE 1

DOWANOL ® compounds (DOW Corp., Midland, MI)

| Name | MW | Evaporation time and temp. | HLB |
|---|---|---|---|
| DPM (dipropylene glycol methyl ether) | 148.2 | Mid to slow evaporating, bp = 190 C., flp = 75 C. | Hydrophilic ~8.2 |
| DPnB (dipropylene glycol n-butyl ether) | 190.3 | Slow evaporating, bp = 230 C., flp = 100.4 C. | Hydrophobic ~6.8 |

TABLE 1-continued

| DOWANOL ® compounds (DOW Corp., Midland, MI) | | | |
|---|---|---|---|
| Name | MW | Evaporation time and temp. | HLB |
| DPnP (dipropylene glycol n-propyl ether) | 176.2 | Slow evaporating, bp = 213 C., flp = 88 C. | Hydrophilic/ Hydrophobic ~7.2 |
| PGDA (propylene glycol diacetate) | 160 | Bp = 190 C., flp = 95 C. | |
| PM (Propylene glycol methyl ether) | 90.1 | Fast evaporating, bp = 120 C., flp = 31 C. | Hydrophilic ~8.3 |
| PnB (propylene glycol n-Butyl ether) | 132.2 | Fast evaporating, bp = 171 C., flp = 63 C. | Hydrophobic ~6.9 |
| PnP (propylene glycol n-propyl ether) | 118.2 | Fast evaporating, bp = 149 C., flp = 48 C. | Hydrophilic/ hydrophobic ~7.4 |
| PPh (propylene glycol phenyl ether) | 152.2 | Slow evaporating, bp = 243 C., flp = 115 C. | Very hydrophobic ~5.9 |
| TPM (Tripropylene glycol methyl ether) | 206.3 | Slow evaporating, bp = 243 C., flp = 121 C. | Hydrophilic ~8 |
| TPnB (tripropylene glycol n-butyl ether) | 248.4 | Slow evaporating, bp = 274 C., flp = 126 C. | Hydrophobic ~6.6 |
| DMM (dipropylene glycol dimethyl ether) | 162.23 | bp = 175 C., flp = 65 C. | Aprotic ~7 |

Figure 2:
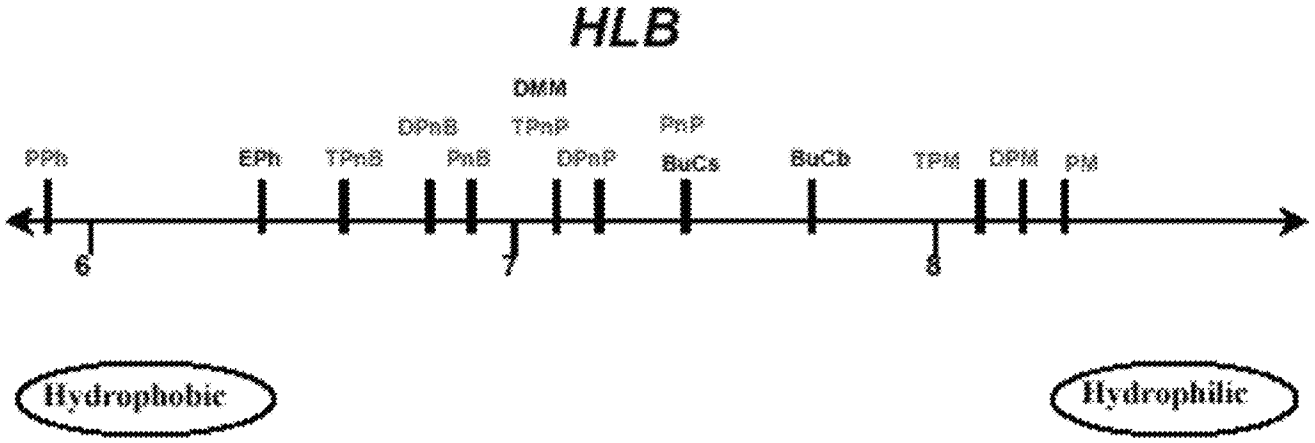
FIG. 2 shows HLB values of debonding agents.

The HLB properties for these products are set forth on FIG. 2.

JEFFAMINE® products (Huntsman Chemicals)

TABLE 2

| JEFFAMINE ® compounds |
|---|
| Jeffamine D-2000 diamine Polyetheramine |
| Jeffamine D-400 |
| Jeffamine M-2070 |
| Jeffamine XTJ 548 |
| Jeffamine XTJ-500 diamine (EO based) Polyetheramines ED-600 |
| Jeffamine XTJ-501 diamine (EO based) Polyetheramine ED-900 |
| Jeffamine XTJ-502 diamine (EO based) Polyetheramine ED-2003 |
| Jeffamine XTJ-505 (M600) |
| Jeffamine XTJ-506 (M-1000) |
| Jeffamine XTJ-507 (M-2005) |
| Jeffamine XTJ-507 (M2005) monoamine polyetheramine |
| Jeffamine XTJ-509 (T-3000) triamine Polyetheramine |
| Jeffamine XTJ-542 (Diamine, M~1000, based on [poly(tetramethylene ether glycol)]/PPG copolymer) |
| Jeffamine XTJ-559 (Diamine, M~1000, based on [poly(tetramethylene ether glycol)]/PPG copolymer) |
| Jeffamine XTJ-576 (SD-2001) (D-2000 based but both ends are secondary amine) |
| Jeffamine XTJ-585 (SD-401) (D-400 based but both ends are secondary amine) |

Example 1

Handsheet Preparation

To prepare handsheets of ~200 grams per square meter (GSM) a 0.5% fluff pulp slurry was thoroughly dispersed using an overhead mixer. To this, appropriate amounts of 2% Dowanol solution were added to create a specific concentration of the Dowanol in the water, as described in the Examples below. These constituents were mixed for 30 s and then put into the handsheet mold. Shear was applied using an overhead stirrer mixing at 1100 rpm for 5 seconds, 700 rpm for 5 seconds, and then 400 rpm for 5 seconds. Following this, the sample in the mold was allowed to drain and vacuum was applied to remove excess water. The resultant sheet was blotted, pressed, and dried in rings in the oven at 110° C. for 14 minutes.

Example 2

Caliper Measurements

The thickness or the caliper was measured using a digital caliper for paper strips treated with volatile debonders by dipping 1" by 6" strips of 670 GSM basis weight paper strips for approximately 30 seconds in 50 mL centrifuge tubes containing solutions containing debonder compounds in deionized water at concentration ranging from 1%/wt, to 0.01%/wt until the strips were saturated. The resulting samples were then pressed and dried at 110° C. for 20 minutes. For these experiments, samples were prepared using compounds listed in the materials section, with an untreated sample as the control.

Example 3

Tensile Strength Measurement

Tensile tests were conducted on control and experimental samples using an Instron 3343. Samples of sheets for tensile testing were initially cut into 1 inch (in) wide strips with a paper cutter, and then attached within the Instron 3343. The gauge length region was set at 4 in and the crosshead speed was 1 in/minute. Thickness was measured to provide stress data as was the weight to be able to normalize the data by weight of samples. The strips were tested to failure with an appropriate load cell. At least three strips from each control or experimental handsheet sample were tested and the values were averaged together.

Example 4

Measurement of Cross Section Using Caliper and Microscopy

Figure 3B:
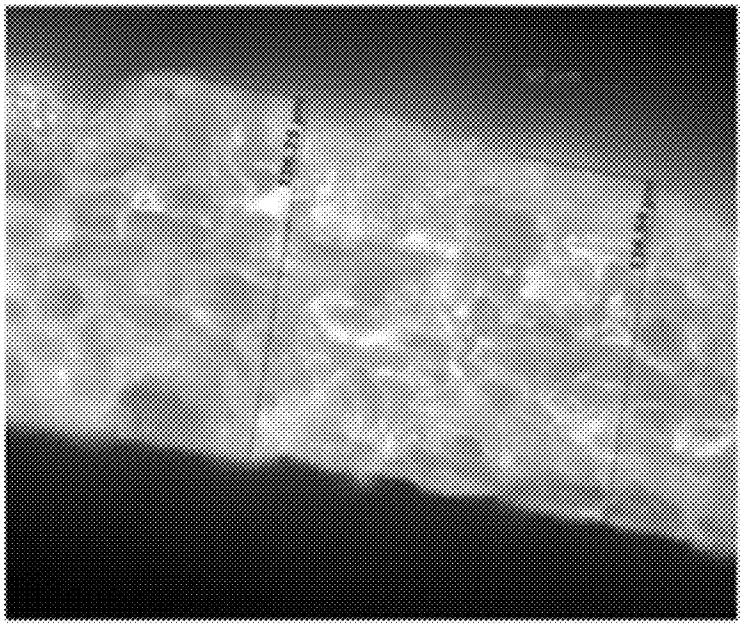
FIGS. 3A and 3B show microscopy images of paper cross-sections.
Figure 3A:
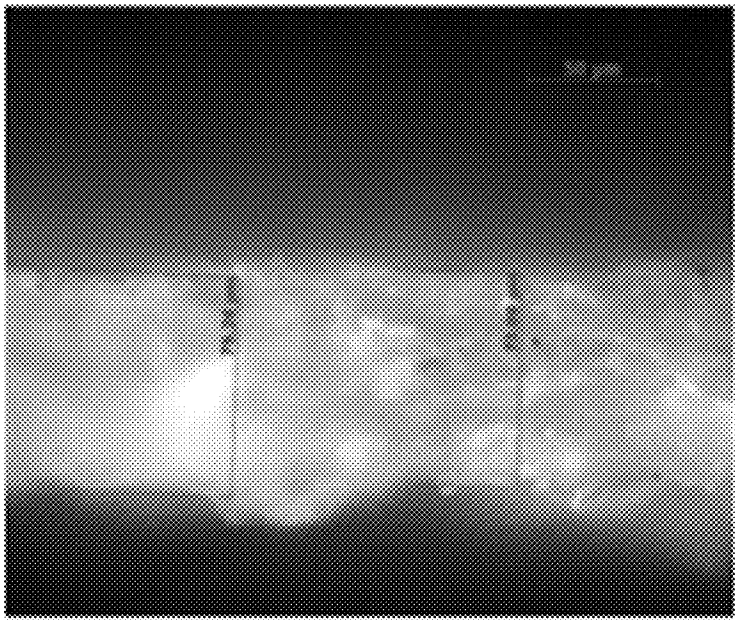

Microscopic images were captured with a Zeiss Axio microscope using an EC Epiplan-NEOFLUAR 20× objective lens and digitalized with an Axio MRC5 camera. Cross sections in MD and CD were prepared using a 15T sterile disposable scalpel and straight-edge. Microscopic images were digitally analyzed with AxioVision Rel. 4.8.2 for Zeiss. An example of microscopy images showing bulking improvement is shown in FIG. 3. FIG. 3A shows the microscopic image of a control sample. FIG. 3B shows a microscopic image of a sample that was treated with a 1% solution of TPnB glycol ether in 4% starch solution.

Example 5

Wet End Addition of Volatile Debonder

Figure 4:
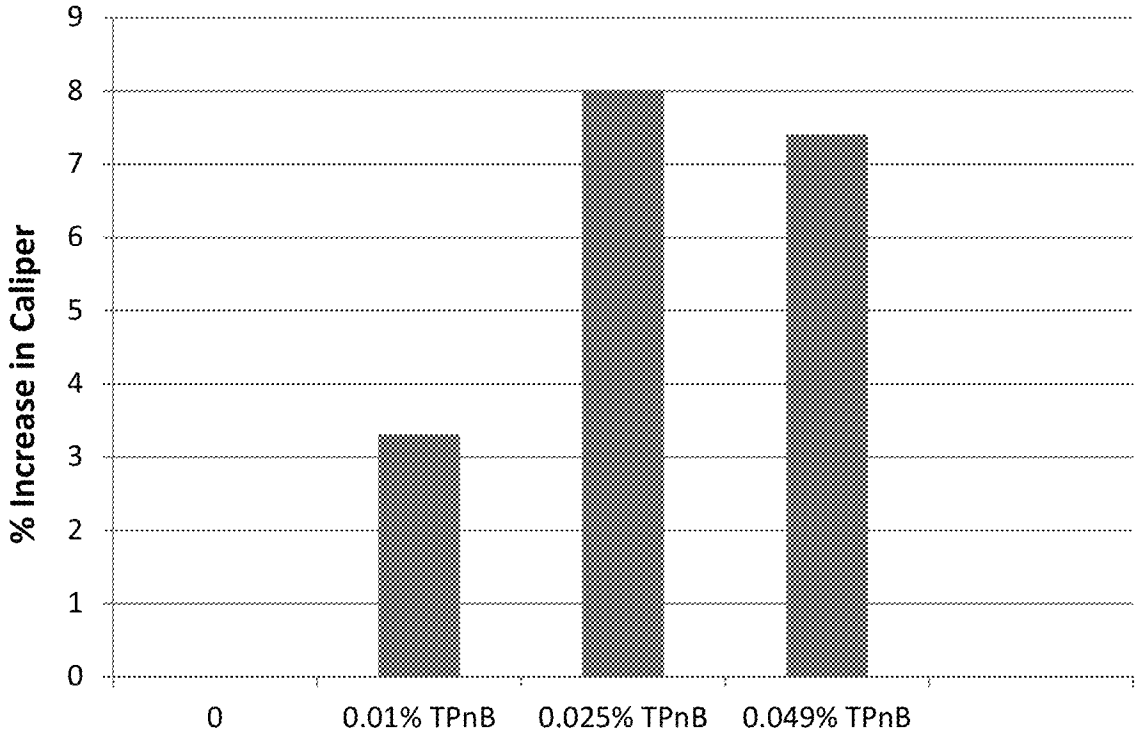
FIG. 4 shows a graph of caliper increase for different debonder concentrations.

Handsheet samples were prepared using the method in Example 1. Dowanol TPnB were applied to the handsheets at concentrations of 0.01%, 0.025%, 0.049%. The caliper of the handsheet samples was measured using the methods in Example 2. The results of these tests are shown in the graph in FIG. 4. As shown in this Figure, handsheet samples treated with TPnB showed a greater increase in caliper as a function of its concentration in the white water, with a maximum caliper increase of about 8% with a TPnB concentration of 0.025%.

Example 6

Thermogravimetry (TG) and TG-Mass Spectrometry (TG-MS) Testing

Samples were prepared using the method in Example 1, using 0%, 0.049%, and 0.095% Dowanol TPnB. Other samples were prepared with the same concentrations but with skipping the drying step from Example 1. The wet samples were tested using TG to examine any changes in the weight loss profile, and the dry samples were tested using TG-MS to determine the amount of the residual debonder on the fibers. It was observed that the use of the volatile debonder did not significantly affect the weight loss of the wet sample. These tests also did not demonstrate any residual debonder on the dry sample (TG-MS scan profiles were the same for controls and treated samples).

Example 7

Preparation of Sizing Solutions with Bulking Additives

Bulking solutions were prepared from a 4% cooked starch stock solution. The stock solution was prepared by heating 4% solids by weight granulated ethylated starch in deionized water. The mixture was heated to 65° C. while stirring and held at constant temperature for 10 minutes and immediately cooled in an ice bath. Starch solution samples were taken during and after cooking to ensure complete cooking and no degradation. Viscosity of the stock starch solution was tested at room temperature (20° C.) at 60, 100, and 150 rpm. Bulking solutions were made by adding undiluted debonding agent/bulking agent to stock starch solution.

Example 8

Size Press Application of Debonder to Improve Sheet Bulking

Figure 5:
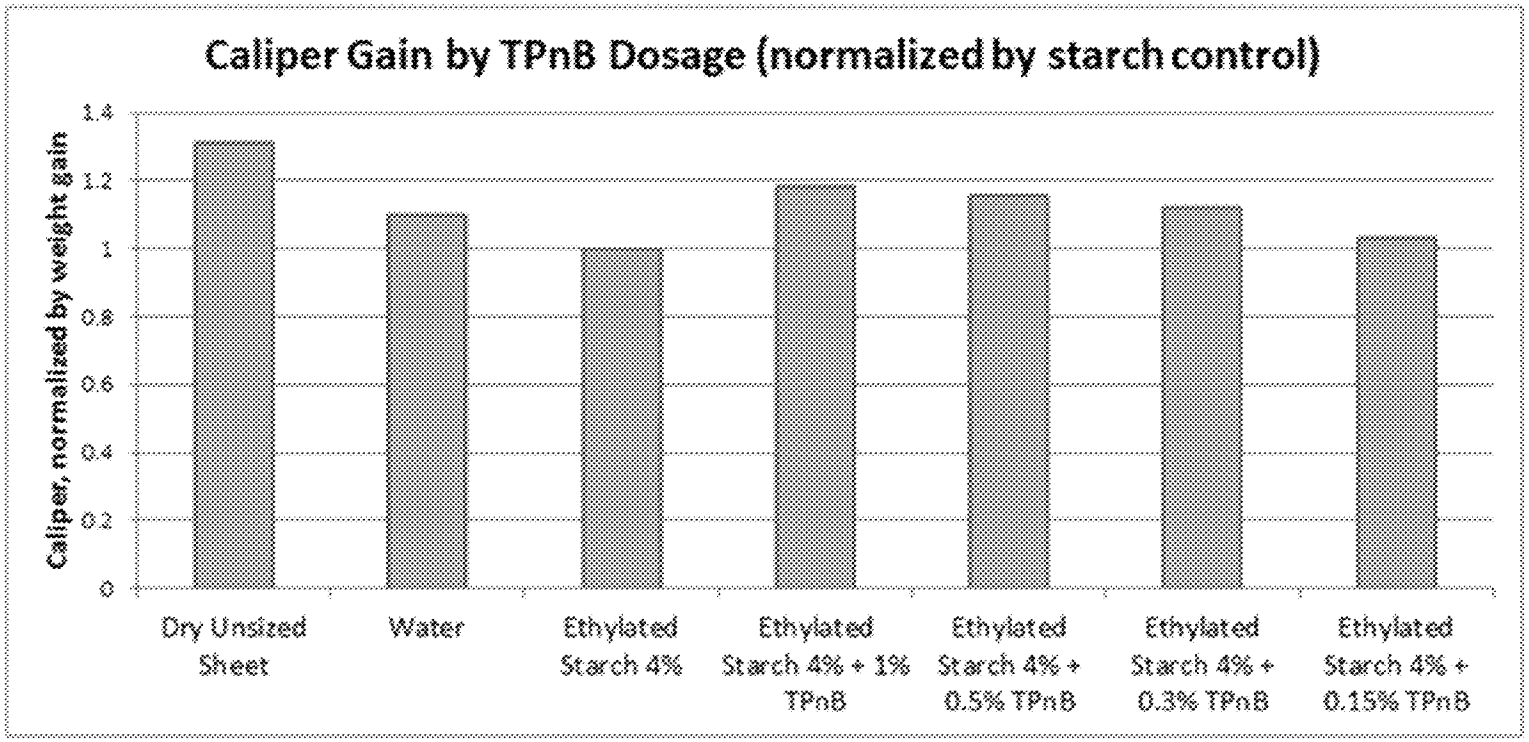
FIG. 5 shows bulking improvement as a function of debonder concentration in starch sizing solution.

Sheet bulking samples were prepared by cutting 1"×1" squares and 1"×7" strips (CD) from unsized sheets, weighed, and dipped into the bulking solutions for 10 seconds each. Control samples were dipped into deionized water (blank) and starch stock solution. After dipping, they were placed between two metal plates and pressed with a constant-pressure metal roller. They were dried on a speed dryer at 150 degrees C. and re-weighed after conditioning to 50% relative humidity. The results of these tests are set forth in the graphs on FIG. 5.

Example 9

Tensile Strength of Papers with Improved Bulking

Figure 6:
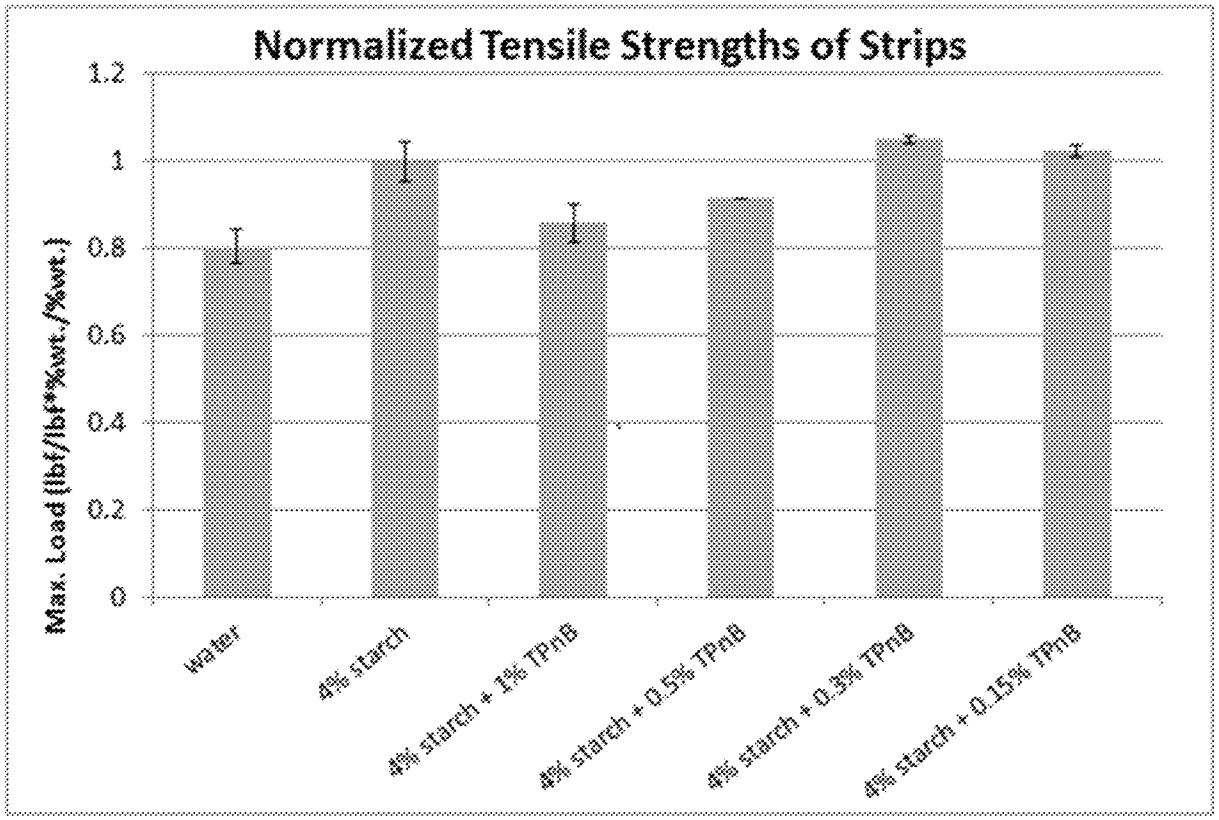
FIG. 6 shows normalized tensile strength of treated paper vs. control.

The effect of debonding molecules in the sizing solution was investigated as a function of TPnB concentration in 4% starch solution. The graph in FIG. 6 shows that there is no tensile strength loss when TPnB is added at concentrations up to 0.3%, while higher concentrations up to 0.3% show a tensile loss of 10-20% is observed when normalized by the sample sized with starch alone.

Example 10

Screening of Debonding Chemicals

Figure 7:
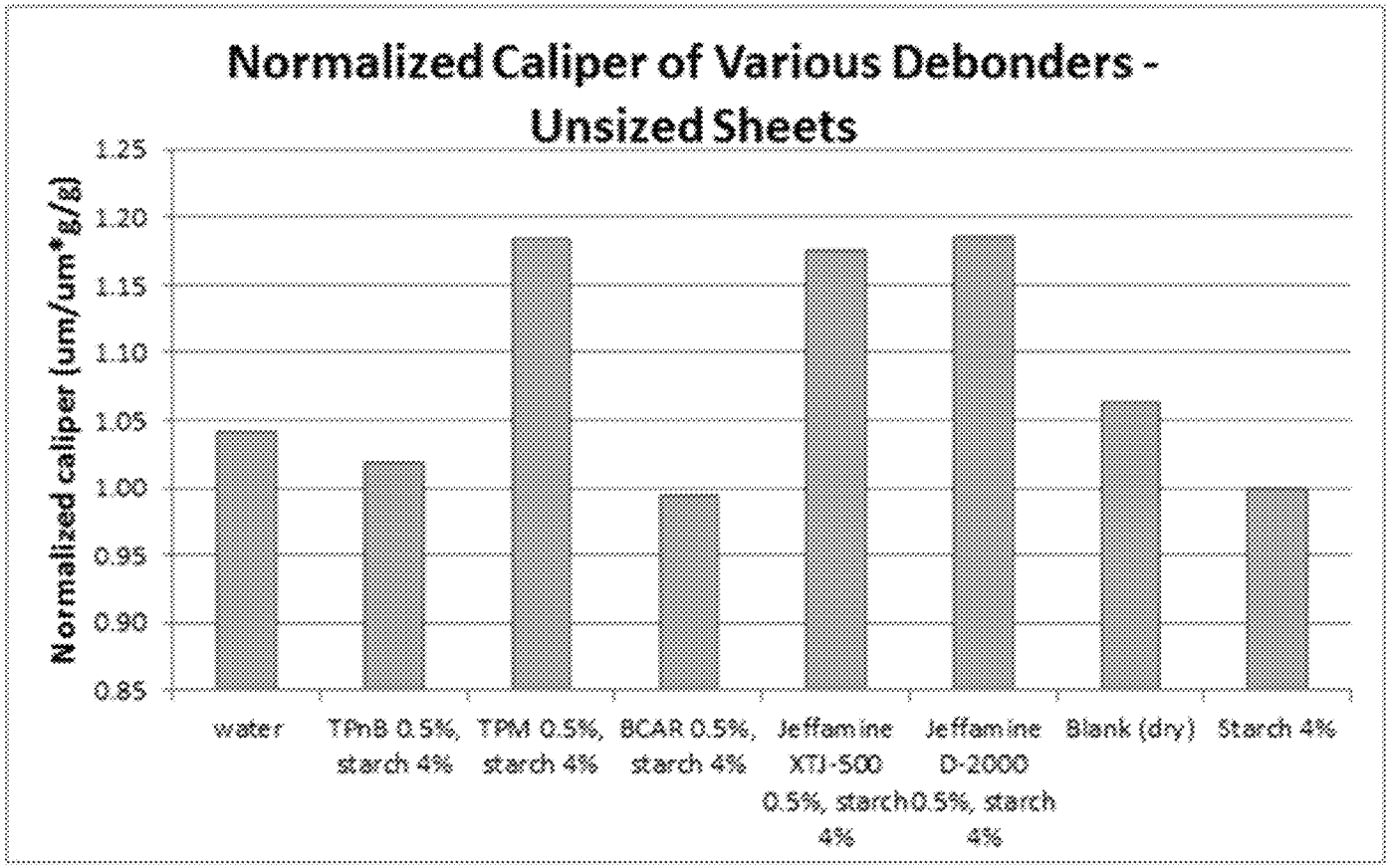
FIG. 7 shows normalized caliper of treated paper vs. control.

A selection of glycol ethers, including TPnB, TPM and BCAR, were compared to PPO-containing molecules such as Jeffamine XTJ-500 and Jeffamine D-2000 by using the protocol described in Examples 2 and 8. The graph in FIG. 7 shows the bulking improvement obtained by an addition of 0.5% by weight of each debonding molecule to a 4% starch sizing solution.

Example 11

Taber Stiffness Analysis

Figure 8:
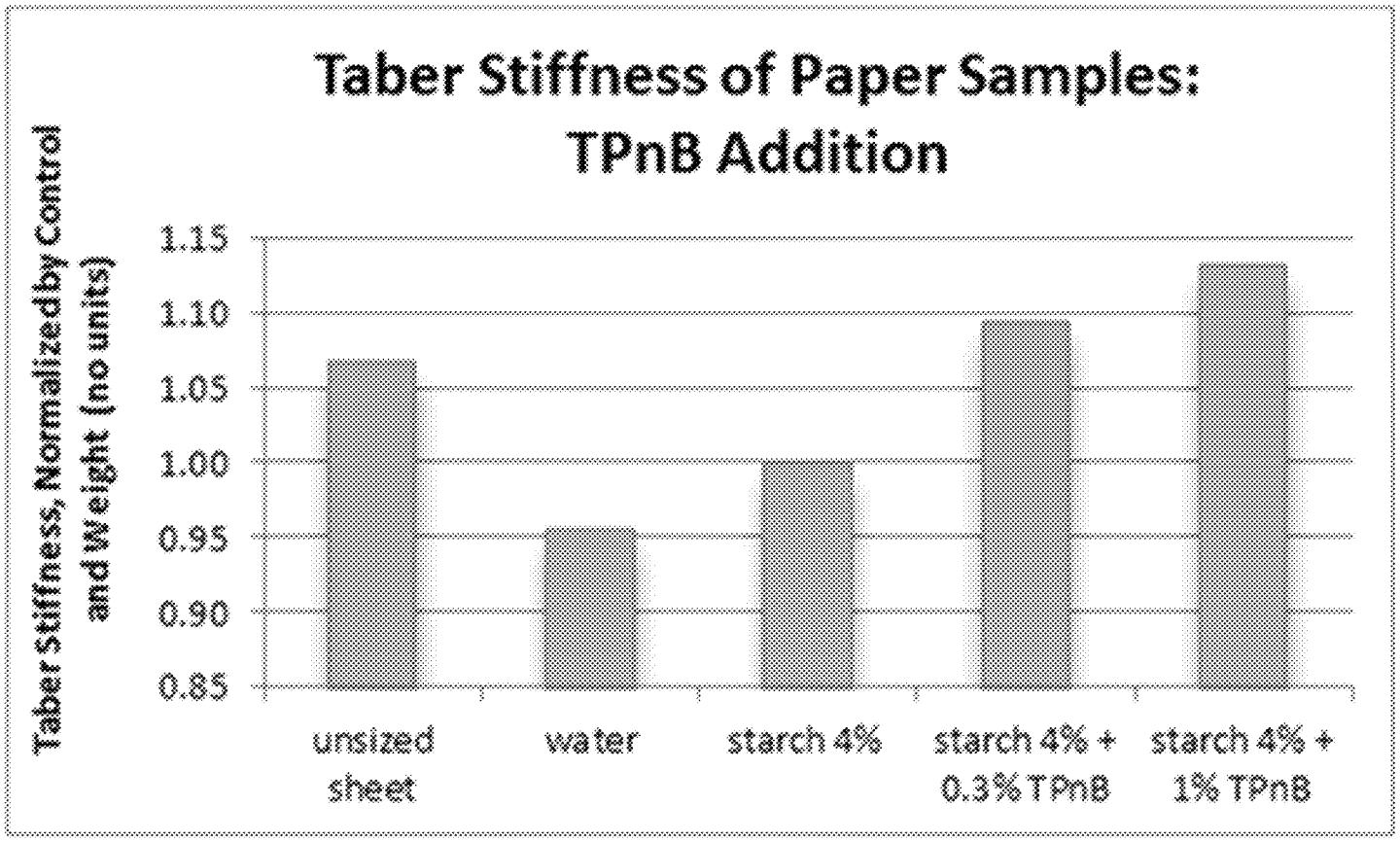
FIG. 8 shows a graph of stiffness of treated paper vs. control.

The prepared sheets containing cooked starch and TPnB were conditioned to 45% RH for 2 hours. The samples were prepared using a 1.50"×2.75" Triple Cut Specimen Shear (Model 104-11, Taber Industries, N. Tonawanda, N.Y., USA), with 5 samples per condition in the machine direction. The samples were then tested on a Taber V-5 Stiffness Tester (Model 150-B, Taber Industries, N. Tonawanda, N.Y., USA) with a Ten Unit Compensator Weight (for samples between 0-10 Taber Stiffness Units). In accordance with the method as expressed in TAPPI 489, each sample was tested 15 degrees in the left and right direction and the stiffness was recorded as an average of the two readings, in Taber Stiffness Units. The readings were recorded and are expressed as an average per condition (n=5) and are shown in FIG. 8.

Example 12

Measurement of Viscosity of Starch Solutions

Figure 9:
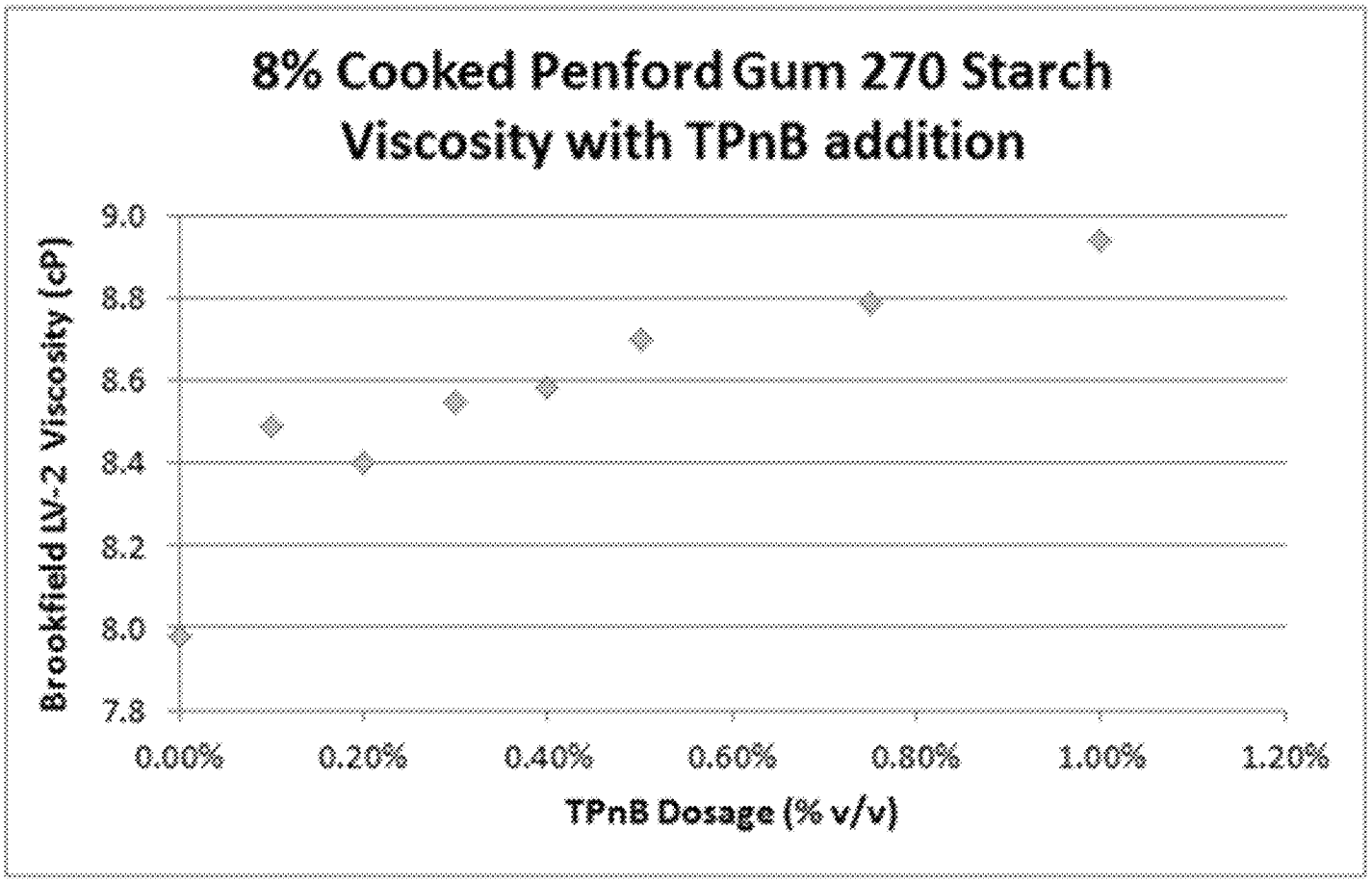
FIG. 9 shows a graph of viscosity for cooked starch with various amounts of TPnB additive.

A solution of cooked 8% Penford Gum 270 ethylated starch was prepared. 250 mL of the solution was transferred to a glass beaker and heated to 55° C. on a constant-temperature stir plate in conjugation with a Brookfield Rheometer (Model LVDV-III+, Brookfield Engineering Laboratories, Middleboro, Mass., USA) with external control (Rheocalc V2.4 Software) that was zeroed and fitted with an LV-2 spindle. A viscosity reading was taken of the cooked 8% starch solution, and then 0.25 mL (0.1%) TPnB was added. After 5 minutes of mixing, another reading was taken. This was repeated for readings at 0.2%, 0.3%, 0.4% and 0.5%. After 0.5%, 0.625 mL (0.25%) TPnB was added and a reading of 0.75% TPnB concentration was taken, after 5 minutes another 0.625 mL was added and a reading of 1% TPnB was taken. The viscosity vs. TPnB concentration graph is shown in FIG. 9.

Example 13

Taber Stiffness Analysis

Samples were prepared and tested as set forth in Example 11. Results are set forth in FIG. 10. The data in the graph of FIG. 10 demonstrate the benefit in improved stiffness obtained by using the bulking agent with starch in the sizing solution.

Equivalents

While specific embodiments of the subject invention have been disclosed herein, the above specification is illustrative and not restrictive. While this invention has been particularly shown and described with references to preferred embodiments thereof, it will be understood by those skilled in the art that various changes in form and details may be made therein without departing from the scope of the invention encompassed by the appended claims. Many variations of the invention will become apparent to those of skilled art upon review of this specification. Unless otherwise indicated, all numbers expressing reaction conditions, quantities of ingredients, and so forth, as used in this specification and the claims are to be understood as being modified in all instances by the term "about." Accordingly, unless indicated to the contrary, the numerical parameters set forth herein are approximations that can vary depending upon the desired properties sought to be obtained by the present invention.

While this invention has been particularly shown and described with references to preferred embodiments thereof, it will be understood by those skilled in the art that various changes in form and details may be made therein without departing from the scope of the invention encompassed by the appended claims.

What is claimed is:

1. A method for increasing the stiffness of a paper product, comprising:

preparing a sizing solution comprising a starch and a volatile debonder;

applying the sizing solution to the paper product during a sizing step of papermaking to form a sized paper product, wherein the volatile debonder is present in the sizing solution in an amount sufficient to reduce hydrogen bonding between the fibers of the paper product; and drying the sized paper product to form a dried paper product, wherein the volatile debonder evaporates during the drying, and wherein the starch is distributed in the dried paper product, and wherein the stiffness of the dried paper product is increased when compared with the stiffness of the paper product treated according to the preceding steps except in the absence of the volatile debonder.

2. The method of claim 1, wherein the sizing solution is applied to the paper product by spraying.

3. A paper product formed by the method of claim 1.

4. The method of claim 1, wherein the volatile debonder is a glycol ether.

5. The method of claim 4, wherein the volatile debonder is an ethylene glycol ether.

6. The method of claim 5, wherein the ethylene glycol ether is selected from the group consisting of ethylene glycol monomethyl ether, ethylene glycol monoethyl ether, ethylene glycol monopropyl ether, ethylene glycol monoisopropyl ether, ethylene glycol monobutyl ether, ethylene glycol monobenzyl ether, ethylene glycol methyl ether acetate, ethylene glycol monethyl ether acetate, and ethylene glycol monobutyl ether acetate.

7. The method of claim 4, wherein the volatile debonder is selected from the group consisting of tripropylene glycol n-butyl ether, tripropylene glycol methyl ether, propylene glycol n-Butyl ether, and dipropylene glycol n-butyl ether.

8. The method of claim 1, wherein the volatile debonder in the sizing solution is in an amount from 0.001% to 0.1% by weight.

9. The method of claim 1, wherein the volatile debonder is present in the sizing solution in an amount from 0.001% to 1% by weight.

* * * * *